US008971497B2

(12) United States Patent
Haider

(10) Patent No.: US 8,971,497 B2
(45) Date of Patent: Mar. 3, 2015

(54) CONTOUR COLLIMATOR AND ADAPTIVE FILTER WITH ELECTROACTIVE POLYMER ELEMENTS AND ASSOCIATED METHOD

(71) Applicant: Sultan Haider, Erlangen, DE (US)

(72) Inventor: Sultan Haider, Erlangen, DE (US)

(73) Assignee: Siemens Aktiengesellschaft, München (DE)

( * ) Notice: Subject to any disclaimer, the term of this patent is extended or adjusted under 35 U.S.C. 154(b) by 203 days.

(21) Appl. No.: 13/761,979

(22) Filed: Feb. 7, 2013

(65) Prior Publication Data

US 2013/0202091 A1 Aug. 8, 2013

(30) Foreign Application Priority Data

Feb. 8, 2012 (DE) ..... 10 2012 201856

(51) Int. Cl.
*G21K 1/02* (2006.01)
*G21K 1/04* (2006.01)
*G21K 1/10* (2006.01)

(52) U.S. Cl.
CPC . *G21K 1/046* (2013.01); *G21K 1/10* (2013.01)
USPC ..... 378/147; 378/150

(58) Field of Classification Search
CPC ..... G21K 1/10; G21K 1/02; G21K 1/025; G21K 1/046
USPC ..... 378/145–151, 156–159
See application file for complete search history.

(56) References Cited

U.S. PATENT DOCUMENTS 3,755,672 A 8/1973 Edholm et al.
4,794,629 A 12/1988 Pastyr et al.
5,037,374 A 8/1991 Carol
5,438,991 A 8/1995 Yu et al.
5,442,675 A 8/1995 Swerdloff et al.
5,559,853 A 9/1996 Linders et al.
5,625,665 A 4/1997 Fokkink et al.
5,677,943 A 10/1997 Hoebel
5,745,279 A 4/1998 Ciscato et al.
5,751,786 A 5/1998 Welters et al.
5,768,340 A 6/1998 Geittner et al.
5,878,111 A 3/1999 Schulz
5,889,834 A 3/1999 Vilsmeier et al.
6,052,436 A 4/2000 Huttner et al.
6,118,855 A 9/2000 Welters et al.
6,269,147 B1 7/2001 Powell
6,453,013 B2 9/2002 Prins
6,757,355 B1 6/2004 Siochi (Continued)

FOREIGN PATENT DOCUMENTS

DE 4 422 780 A1 1/1996
DE 10 2006 039 793 B3 1/2008

OTHER PUBLICATIONS

German Office Action dated Sep. 26, 2012 for corresponding German Patent Application No. DE 10 2012 201 856.5 with English translation.

*Primary Examiner* — Courtney Thomas
(74) *Attorney, Agent, or Firm* — Lempia Summerfield Katz LLC

(57) ABSTRACT

A contour collimator and an adaptive filter as well as an associated method for adjusting a contour of a ray path of x-ray radiation are provided. The contour collimator and the adaptive filter include fluid impermeable for x-ray radiation and a number of electroactive polymer elements actively connected to the fluid. On application of an electrical voltage to the electroactive polymer elements, an aperture forming the contour in the fluid is formed.

20 Claims, 4 Drawing Sheets

(56) References Cited

U.S. PATENT DOCUMENTS

| | | | |
|---|---|---|---|
| 6,813,336 | B1 | 11/2004 | Siochi |
| 6,920,203 | B2 | 7/2005 | Short et al. |
| 7,015,490 | B2 | 3/2006 | Wang et al. |
| 7,180,980 | B2 | 2/2007 | Nguyen |
| 7,224,763 | B2 | 5/2007 | Naidu et al. |
| 7,254,216 | B2 | 8/2007 | Thandiackal et al. |
| 7,272,208 | B2 | 9/2007 | Yatsenko et al. |
| 7,308,073 | B2 | 12/2007 | Tkaczyk et al. |
| 7,386,099 | B1 | 6/2008 | Kasper et al. |
| 7,894,574 | B1 | 2/2011 | Nord et al. |
| 7,993,058 | B2 | 8/2011 | Bohn et al. |
| 2003/0202632 | A1 | 10/2003 | Svatos et al. |
| 2004/0105525 | A1 | 6/2004 | Short et al. |
| 2005/0058245 | A1 | 3/2005 | Ein-Gal |
| 2009/0041199 | A1 | 2/2009 | Bohn |

CONTOUR COLLIMATOR AND ADAPTIVE FILTER WITH ELECTROACTIVE POLYMER ELEMENTS AND ASSOCIATED METHOD

This application claims the benefit of DE 10 2012 201 856.5, filed on Feb. 8, 2012, which is hereby incorporated by reference.

BACKGROUND

The present embodiments relate to a contour collimator or an adaptive filter and an associated method for adjusting a contour of a ray path of x-ray radiation.

A contour collimator is used in radiation therapy for treatment of tumors. In radiation therapy, a tumor is irradiated with energy-rich radiation (e.g., with high-energy x-ray radiation of a linear accelerator). In such treatment, the contour collimator is brought into the ray path of the x-ray radiation. The contour collimator has an opening, through which radiation may pass. The contour of the opening is intended to correspond to the contour of the tumor. The contour thus forms an aperture for the passage of the x-ray radiation. This provides that the tumor, and not the adjoining healthy body tissue, is irradiated with the x-ray radiation. By embodying the contour collimator in a suitable manner almost any given contour of a tumor may be mapped.

Collimators widely used for radiation therapy are multi-leaf collimators, as described, for example, in patent DE 10 2006 039793 B3. The multi-leaf collimator has a number of leaves (e.g., 160 leaves) able to be moved by motors in relation to one another to form the opening. The leaves include a material absorbing the x-ray radiation. Two packages of leaves are disposed opposite one another so that the leaves may be moved with end face sides towards one another or away from one another.

Each of these leaves is displaceable individually using an electric motor. Since there may be slight deviations in the positioning of the leaves between a required specification and the actual position of the leaves currently set, each leaf has a position measurement device, with which the position currently set may be determined.

In examinations with the aid of x-rays, the patient or organs of the patient may exhibit a greatly differing absorption behavior with respect to the applied x-ray radiation in the area under examination. For example, in images of the thorax, the attenuation in the area in front of the lungs is very large, as a result of the organs disposed there, while in the area of the lungs, the attenuation is small. Both to obtain an informative image and also to protect the patient, the applied dose may be adjusted as a function of the area so that more x-ray radiation than necessary is not supplied. This provides that a larger dose is to be applied in the areas with high attenuation than in the areas with low attenuation. In addition, there are applications, in which only a part of the area under examination is to be imaged with high diagnostic quality (e.g., with little noise). The surrounding parts are of importance for orientation but not for the actual diagnosis. These surrounding areas may thus be mapped with a lower dose in order to reduce the overall applied dose.

Filters are used to attenuate the x-ray radiation. Such a filter is known, for example, from DE 44 22 780 A1. This has a housing with a controllable electrode matrix, by which an electrical field that acts on a fluid connected to the electrode matrix, in which x-ray radiation-absorbing ions are present, is able to be generated. These are freely movable and move around according to the field applied. By forming an appropriate field, many or few ions may accumulate correspondingly in the area of one or more electrodes in order to change the absorption behavior of the filter locally.

Polymers are known from the prior art that change shape through the application of an electrical voltage. The polymers may be electroactive polymers (EAP). An example for an electroactive polymer is a dielectric elastomer. A dielectric elastomer converts electrical energy directly into mechanical work. An actuator based on a dielectric elastomer may be filtered, for example, by an elastomer film being coated on both sides with electrodes, to which an electrical voltage may be applied. Through the applied voltage, the elastomer film is pressed together in the width direction. The elastomer film expands laterally. In this process, the elastomer film may perform work and thus acts as an actuator. If the voltage between the electrodes is removed again, the elastomer film assumes an original shape again.

SUMMARY AND DESCRIPTION

The present embodiments may obviate one or more of the drawbacks or limitations in the related art. For example, a further contour collimator and a further adaptive filter that may map a contour robustly and rapidly are provided. In another example, an appropriate method for forming a contour is provided.

An aperture forming the contour is generated with the aid of electroactive polymer elements (EAP elements) in a fluid absorbing x-ray radiation or in a fluid impermeable for x-ray radiation. In such cases, by applying an electrical voltage to the EAP elements, the fluid or parts of the fluid are displaced such that the aperture allowing the passage of x-rays is produced. EAPs are polymers that may change shape through the application of an electrical voltage.

In one embodiment, a contour collimator or an adaptive filter for adjusting a contour of a ray path of x-ray radiation is provided. The apparatus includes a fluid impermeable for x-ray radiation and electroactive polymer elements actively connected to the fluid. The electroactive polymer elements are disposed and embodied such that the electroactive polymer elements form an aperture forming the contour in the fluid by application of an electrical voltage. The polymer elements activated by the voltage partly displace the fluid through the changing shape. The advantage offered by the embodiment is that the contour of a contour collimator or of an adaptive filter may be adjusted rapidly and robustly.

In one embodiment, the fluid is a eutectic alloy of gallium, indium and tin. Such a fluid is available commercially under the trade name Galinstan®.

In a further embodiment, the contour collimator or the adaptive filter may include a first layered unit that is filled with the fluid.

The contour collimator or the adaptive filter may include a second layered unit having the electroactive polymer elements and electric leads for supplying the voltage.

In one embodiment, the contour collimator or the adaptive filter may have a third layered unit impermeable for x-ray radiation with a plurality of indentations disposed in the form of a grid.

In a further embodiment, the first layered unit may be disposed between the second and the third layered unit such that, on application of the electrical voltage, the electroactive polymer elements are able to be pressed into the indentations of the third layered unit. In such cases, the fluid is displaced from the areas of the indentations, so that the aperture is made in the first layered unit.

In a development, the contour collimator or the adaptive filter may include at least one voltage source and switching elements, via which the electroactive polymer elements are supplied with voltage from the voltage source.

The contour collimator or the adaptive filter may have an electrical control unit that controls or switches on the switching elements such that the aperture is formed.

In one embodiment, a number of first, second and third layered units may be stacked.

In another embodiment, a method for adjusting a contour of a ray path of x-ray radiation with a contour collimator or with an adaptive filter is provided. By applying an electrical voltage to a number of electroactive polymer elements, an aperture forming the contour is formed in a fluid impermeable for x-ray radiation. The electroactive polymer elements activated by the voltage partly displace the fluid.

In addition, the electroactive polymer elements may be activated and deactivated by switching elements conducting the voltage (e.g., disconnected from the voltage source or connected to the voltage source).

DETAILED DESCRIPTION OF THE DRAWINGS

Figure 1:
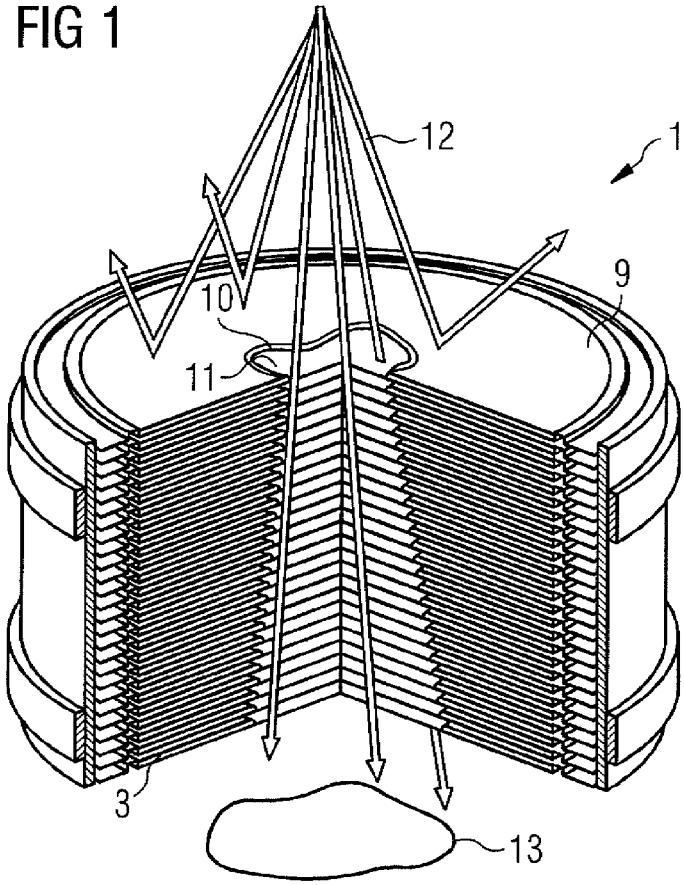
FIG. 1 shows a perspective view of one embodiment of a contour collimator

FIG. 1 shows a perspective diagram of one embodiment of a contour collimator 1 with a number of stacked collimator plates 3. Embodied in the collimator plates 3 are apertures 11 forming a contour 10. The apertures 11 allow x-ray radiation 12 to pass through to an object 13 (e.g., a tumor). Except for the aperture 11, the collimator plates 3 are impermeable for the x-ray radiation 12. The layered units absorbing the x-ray radiation 12 are formed by a fluid 9 absorbing x-ray radiation. Such fluids are, for example, available on the market under the trade name Galinstan®. The aperture 11 is formed where the fluid 9 is displaced or is absent.

Figure 2:
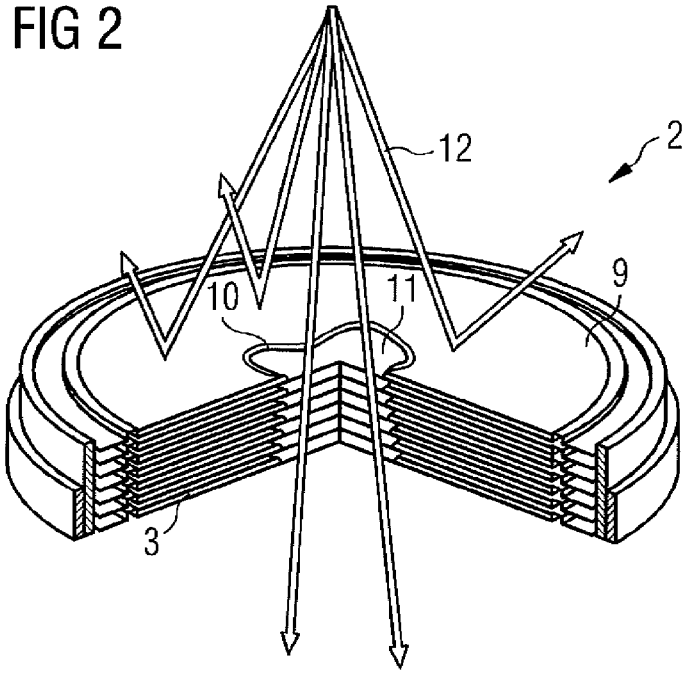
FIG. 2 shows a perspective view of one embodiment of an adaptive filter.

FIG. 2 shows a perspective diagram of one embodiment of an adaptive filter 2 with three stacked filter plates 3. Embodied in the filter plates 3 are apertures 11 forming the contour 10. The apertures 11 let x-ray radiation 12 pass. Except for the apertures 11, the filter plates 3 are impermeable for the x-ray radiation 12. The layered units absorbing x-ray radiation 12 are formed by a fluid 9 absorbing the x-ray radiation 12. Where the fluid 9 is displaced or is absent, the apertures 11 are formed.

Figure 3:
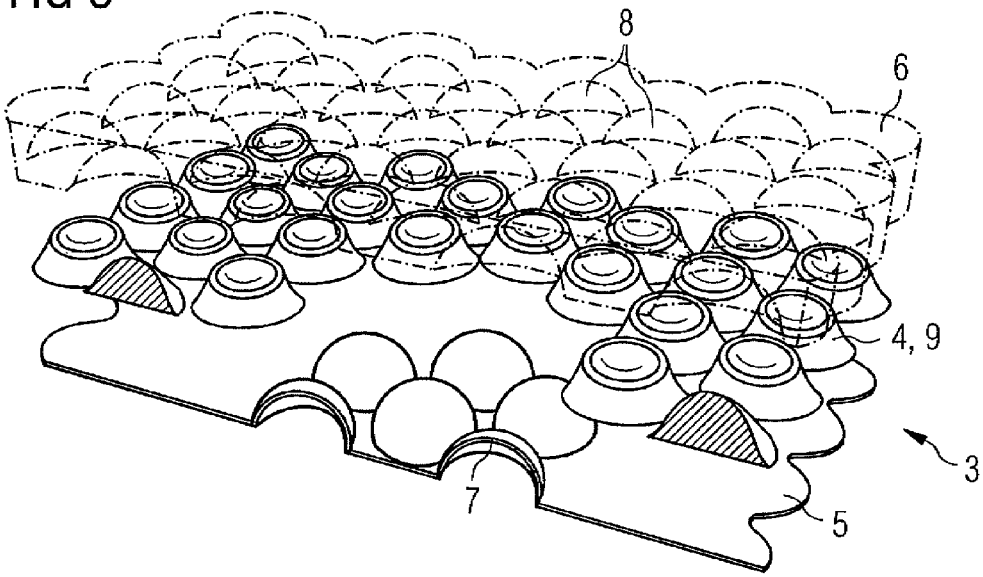
FIG. 3 shows a perspective exploded view of one embodiment of a plate forming the contour collimator or the filter.

FIG. 3 shows a section of one embodiment of a collimator plate or of a filter plate 3 in an exploded view. The plate 3 includes a first layered unit 4 that is disposed between a second and a third layered unit 5, 6. In the first layered unit 4, there is the fluid 9 for absorbing the x-ray radiation. The second layered unit 5 includes a number of electroactive polymer elements 7 and electrical wiring for applying an electrical voltage not shown in the diagram. The third layered unit 6 includes a material transparent for x-ray radiation and possesses a plurality of indentations 8 that are disposed in the form of a grid. By application of an electrical voltage to the second layered unit 5, the electroactive polymer elements 7 are pressed into the indentations 8, which displaces the fluid 9 from areas of the first layered unit 4 corresponding thereto.

Figure 4:
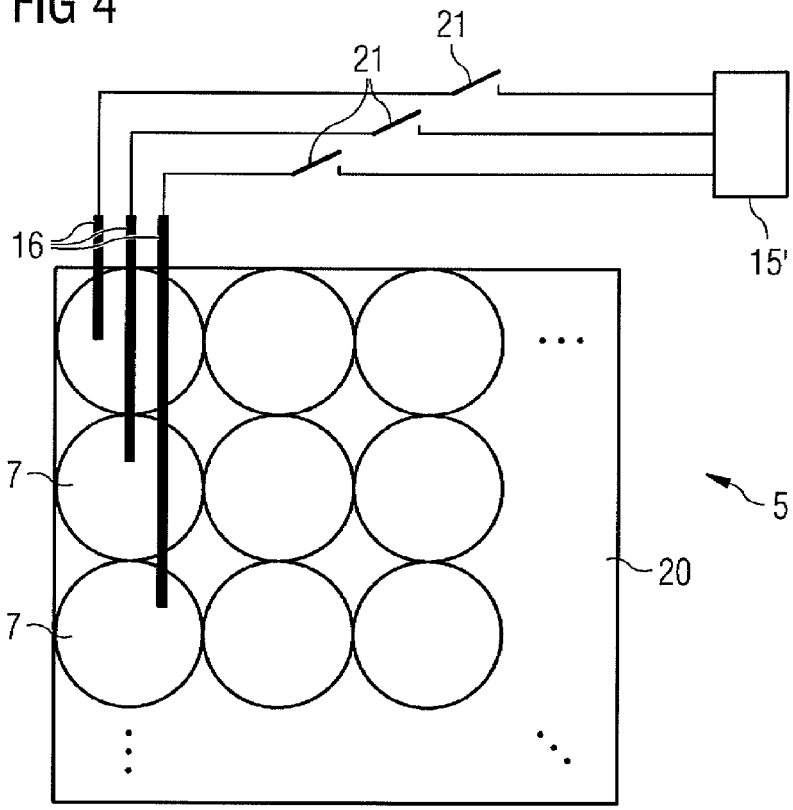
FIG. 4 shows an overhead view of one embodiment of second layered units with electroactive polymer elements arranged thereon and the wiring.

FIG. 4 shows an overhead view of one embodiment of the second layered unit 5. The circular electroactive polymer elements 7, which are disposed on a carrier plate 20, are shown in the diagram. Each polymer element 7 is connected by a separate copper cable 16 to a switching element 21. The switching elements 21 are connected electrically-conductively to a voltage source 15. If the switching element 21 is switched on, electrical potential is present at the polymer element 7. Since each polymer element 7 is supplied with voltage individually, the polymer elements 7 may also be activated individually. This enables the aperture in the shape of the desired contour to be formed. The resolution of the contour increases with the number of polymer elements 7 and the smaller the elements are.

Figure 5:
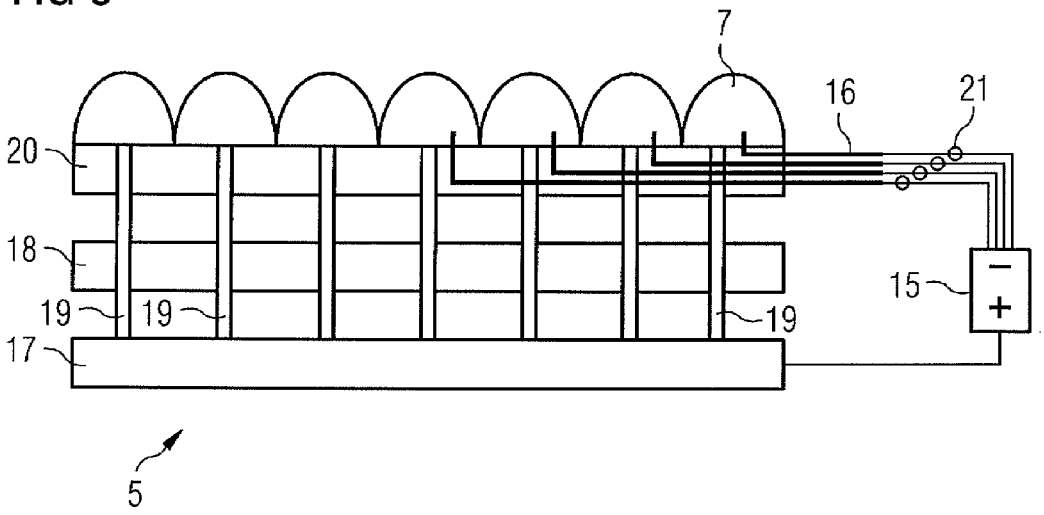
FIG. 5 shows a sectional view of one embodiment of one second layered unit with the electrical wiring.

FIG. 5 shows a longitudinal section through a part of one embodiment of the second layered unit 5. An insulation layer 18 lies on a printed circuit board 17 made of copper. Contact wires 19 are fed through the insulation layer that connect the circuit board 17 to the electroactive polymer elements 7 attached to a carrier plate 20. The printed circuit board 17 is connected to a plus pole of the voltage source 15. The polymer elements 7 are connected via the switching elements 21 to a minus pole of the voltage source 15 with electrical leads (e.g., copper cables 16) that are connected to the polymer elements 7. The raised shape of the polymer elements 7 indicates that these are activated.

Figure 6:
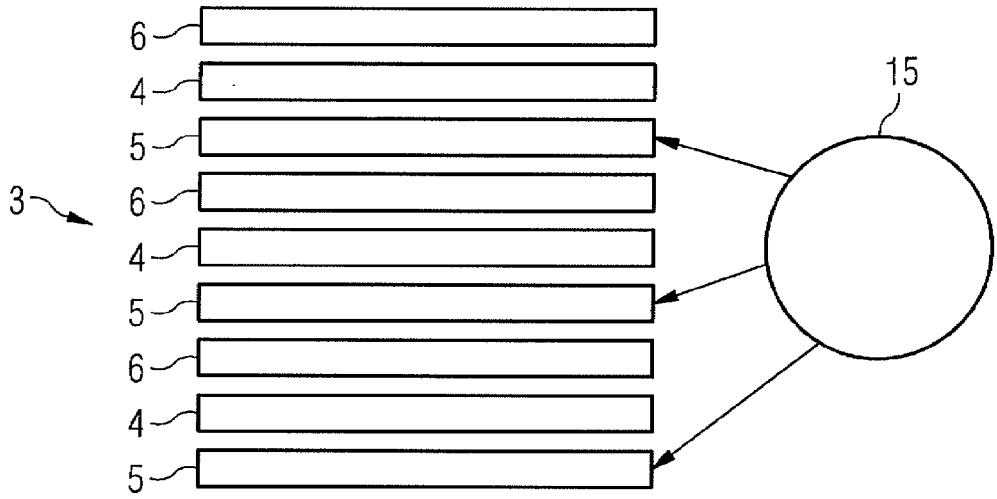
FIG. 6 shows a sectional view of one embodiment of the stacked layered units with a voltage source.
Figure 7:
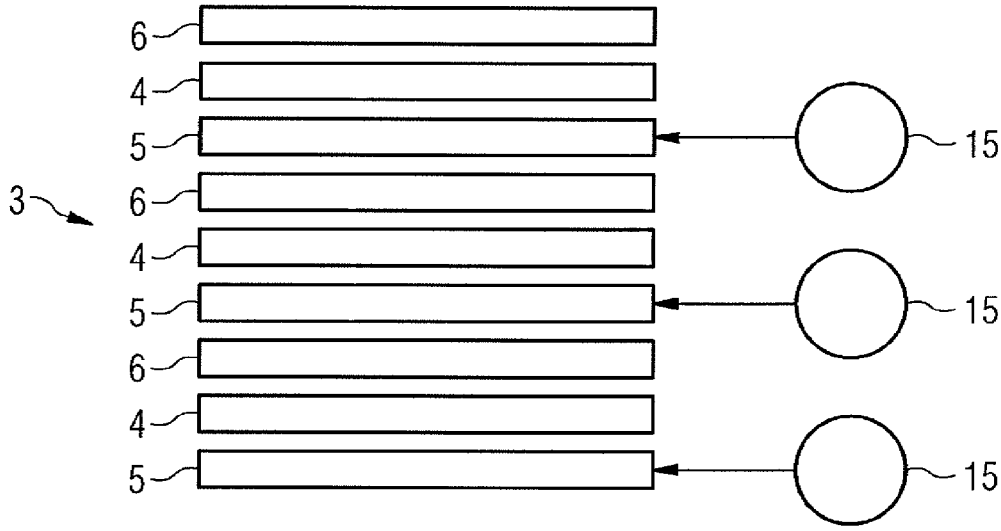
FIG. 7 shows a sectional view of one embodiment of the stacked layered units with a number of voltage sources.

In FIG. 6, three plates 3 of one embodiment of a contour collimator 1 are presented in a block diagram. Each plate 3 includes the stacked first, second and third layered units 4, 5, 6. The second layered unit 5 is supplied by a single voltage source 15.

In FIG. 6, three plates 3 of one embodiment of a filter 2 are shown in block diagram. Each filter plate 3 includes the stacked first, second and third layered units 4, 5, 6. The second layered units 5 are each supplied by a separate voltage source 15.

The contour collimator is used for x-ray radiation therapy, and the filter is used for x-ray imaging.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A contour collimator or adaptive filter for adjusting a contour of a ray path of x-ray radiation, the contour collimator comprising:

a fluid impermeable for x-ray radiation; and electroactive polymer elements actively connected to the fluid, the electroactive polymer elements being disposed and configured such that, by application of an electrical voltage to at least one of the electroactive polymer elements, the fluid is partly displaceable, an aperture forming the contour in the fluid being formed through the fluid.

2. The contour collimator or adaptive filter as claimed in claim 1, wherein the fluid is an eutectic alloy that includes gallium, indium and tin.

3. The contour collimator or adaptive filter as claimed in claim 1, further comprising a first layered unit with the fluid.

4. The contour collimator or adaptive filter as claimed in claim 3, further comprising a second layered unit with the electroactive polymer elements and electrical leads to supply the electrical voltage.

5. The contour collimator or adaptive filter as claimed in claim 4, further comprising a third layered unit permeable for x-ray radiation with a plurality of indentations disposed in the shape of a grid.

6. The contour collimator or adaptive filter as claimed in claim 5, wherein the first layered unit is disposed between the second layered unit and the third layered unit such that, on application of the electrical voltage, the electroactive polymer elements are pressable into the indentations of the third layered unit, and wherein the fluid is displaced from areas below the indentations so that the aperture is produced in the first layered unit.

7. The contour collimator or adaptive filter as claimed in claim 1, further comprising:

at least one voltage source; and switching elements that connect the electroactive polymer elements electrically to the at least one voltage source.

8. The contour collimator or adaptive filter as claimed in claim 7, further comprising an electrical control unit operable to switch on the switching elements such that the aperture is formable.

9. The contour collimator or adaptive filter as claimed in claim 6, wherein a plurality of layered units of the first layered unit, the second layered unit, and the third layered unit are stacked.

10. The contour collimator or adaptive filter as claimed in claim 2, further comprising a first layered unit with the fluid.

11. The contour collimator or adaptive filter as claimed in claim 10, further comprising a second layered unit with the electroactive polymer elements and electrical leads to supply the electrical voltage.

12. The contour collimator or adaptive filter as claimed in claim 11, further comprising a third layered unit permeable for x-ray radiation with a plurality of indentations disposed in the shape of a grid.

13. The contour collimator or adaptive filter as claimed in claim 12, wherein the first layered unit is disposed between the second layered unit and the third layered unit such that, on application of the electrical voltage, the electroactive polymer elements are pressable into the indentations of the third layered unit, and wherein the fluid is displaced from areas below the indentations so that the aperture is produced in the first layered unit.

14. The contour collimator or adaptive filter as claimed in claim 2, further comprising:

at least one voltage source; and switching elements that connect the electroactive polymer elements electrically to the at least one voltage source.

15. The contour collimator or adaptive filter as claimed in claim 3, further comprising:

at least one voltage source; and switching elements that connect the electroactive polymer elements electrically to the at least one voltage source.

16. The contour collimator or adaptive filter as claimed in claim 6, further comprising:

at least one voltage source; and switching elements that connect the electroactive polymer elements electrically to the at least one voltage source.

17. The contour collimator or adaptive filter as claimed in claim 16, further comprising an electrical control unit operable to switch on the switching elements such that the aperture is formable.

18. The contour collimator or adaptive filter as claimed in claim 17, wherein a plurality of layered units of the first layered unit, the second layered unit, and the third layered unit are stacked.

19. A method for adjusting a contour of a ray path of x-ray radiation with a contour collimator or adaptive filter, the method comprising:

applying an electrical voltage to a number of electroactive polymer elements;

forming an aperture of the contour in a fluid impermeable for x-ray radiation by performing the applying, the forming comprising partly displacing the fluid by the electroactive polymer elements activated by the electrical voltage.

20. The method as claimed in claim 19, further comprising activating and deactivating the electroactive polymer elements by switching elements conducting the electrical voltage.

* * * * *